US005603733A

United States Patent [19]

Allen et al.

[11] Patent Number: 5,603,733

[45] Date of Patent: Feb. 18, 1997

[54] LEATHER SOFTENING

[75] Inventors: Adrian S. Allen, North Yorkshire; Finlay D. Aiston, West Yorkshire, both of United Kingdom

[73] Assignee: Allied Colloids Limited, West Yorkshire, United Kingdom

[21] Appl. No.: 564,033

[22] PCT Filed: Apr. 10, 1995

[86] PCT No.: PCT/GB95/00842

§ 371 Date: Dec. 12, 1995

§ 102(e) Date: Dec. 12, 1995

[87] PCT Pub. No.: WO95/27800

PCT Pub. Date: Oct. 19, 1995

[30] Foreign Application Priority Data

Apr. 12, 1994 [GB] United Kingdom ..... 9407226

[51] Int. Cl.[6] ..... C14C 9/00

[52] U.S. Cl. ..... 8/94.21; 8/94.18; 252/8.57; 427/384; 427/389; 428/473

[58] Field of Search ..... 8/94.2, 94.21, 8/94.22, 94.23, 94.33, 94.18; 252/8.57; 427/389, 384; 428/473

[56] References Cited

U.S. PATENT DOCUMENTS

| | | | |
|---|---|---|---|
| 2,754,291 | 7/1956 | Pollack et al. | 8/94.23 |
| 3,300,338 | 1/1967 | Fein et al. | 8/94.23 |
| 4,001,285 | 1/1977 | Hochreuter | 252/8.7 |
| 4,675,021 | 6/1987 | Lach et al. | 8/94.21 |
| 4,729,767 | 3/1988 | Friese et al. | 8/94.23 |
| 5,306,435 | 4/1994 | Ishikawa et al. | 8/94.29 |
| 5,316,860 | 5/1994 | Stewart et al. | 8/94.21 |

FOREIGN PATENT DOCUMENTS

| | | |
|---|---|---|
| 0184741 | 6/1986 | European Pat. Off. . |
| 599279 | 3/1948 | United Kingdom . |
| 1398277 | 6/1975 | United Kingdom . |
| 1401984 | 8/1975 | United Kingdom . |

*Primary Examiner*—Alan D. Diamond

*Attorney, Agent, or Firm*—Sughrue, Mion, Zinn, Macpeak & Seas

[57] ABSTRACT

Leather is rendered flexible and water repellent by treatment with a low molecular weight, generally monomeric, amphoteric surfactant having at least one surfactant hydrophobe, at least two cationic groups and at least two anionic groups which are carboxylic groups.

8 Claims, No Drawings

LEATHER SOFTENING

This application is a 371 of PCT/GB95/00842 filed Apr. 10, 1995.

This invention relates to the treatment of leather so as to render it water-repellant while maintaining or improving its flexibility.

Processes are known for rendering leather water-repellant, often combined with retanning the leather, by the application of certain polymeric materials. Fat liquoring processes may also render the leather water-repellant. Various processes of this type are described in EP-A-372,746, EP-A-412,389 and AU-A-90/60227 and in our European Application No. 93306480.0.

Processes involving the use of a polymeric material have the tendency to reduce the flexibility of the leather.

It is known to treat leather with a conventional amphoteric surfactant, such as coco-amidopropyl betaine, but this is not very effective at rendering the leather either water-repellant or flexible.

Other amphoteric surfactants are known. An example of such surfactants is in GB 1398277. Another amphoteric compound is the sulphonate-containing material described in GB 1401984 as being suitable for finishing textiles, paper or leather. The sulphonate group or groups in such materials would interfere with the properties we are seeking.

It would be desirable to provide an improved treatment of leather by which leather can be given an improved combination of water-repellency and flexibility, including softness.

According to the invention, leather is rendered flexible and water-repellant by a process comprising treating the leather with an aqueous solution of an amphoteric surfactant which has molecular weight below 5,000 and which includes at least 1 surfactant hydrophobe group of at least 8 carbon atoms, at least 2 cationic groups, and at least 2 anionic groups wherein the anionic groups are carboxylic groups.

The invention includes leather impregnated with the defined surfactant.

In this specification we use the term cationic to embrace free base, acid addition and quaternary ammonium salts, and we use the term anionic to embrace free acid and acid salts, of carboxylic acid groups.

The molecular weight must be low in order to achieve the desired flexibility. Generally the molecular weight is below 2000. The surfactant can be a low molecular weight polymeric material or condensate having two or more of the hydrophobic groups; for instance it can be a polymer of 2 to 20usually 3 to 10recurring monomer units some or all of which include a hydrophobic group (for instance R defined below). When the material is a polymer, the molecular weight can be determined by any conventional manner suitable for that polymer, for instance gel permeation chromatography.

Preferably the surfactant is a monomeric material (ie it does not contain a recurring unit derived from a monomer) and usually contains only one of the surfactant hydrophobe groups.

Preferred materials comprise a polyamine on to which is substituted one or more hydrophobic groups and at least two carboxylic acid groups.

Preferred surfactants for use in the invention have the formula $$R-Z-[NA-]_{n}NQ_2$$
$$\quad\quad\quad with acidic sites in the leather. Similarly, free acid groups in the surfactant (M=H) will react with amino groups in the leather.

The surfactant is usually supplied in the form of an aqueous concentrate containing from 10 to 50% of the surfactant and which generally has a pH of 5 to 8. The surfactant is usually applied to the leather as an aqueous solution having a concentration of 0.5 to 5% and a pH of 5 to 8.

The treatment of the leather with the surfactant may be achieved by contacting the leather with an amount of solution such that the amount of surfactant present in the solution is from 0.5 to 5% by weight based on the weight of leather. Contact is best made by soaking the leather in the solution with agitation for a period of 10 minutes to 3 hours, generally about 30 minutes to 90 minutes, and at a temperature of 20° to 60° C., often around 30° to 50° C.

The leather may additionally be subjected to treatment with a water-proofing resin, in which event the surfactant has the advantage of maintaining good flexibility and softness in the leather despite the water proofing resin. For instance the process of the invention can be combined with the process described in Application No. 93306480.0.

When the surfactant is being applied in a treatment that also involves a resin, the resin and the surfactant can be applied sequentially in either order or simultaneously, but preferably either the resin is included in the surfactant solution or the surfactant is applied after the resin.

In the following examples

RESIN A is a waterproofing retanning resin which is a polymer of 0.6 moles of mono ceto stearyl maleate, 0.4 moles maleic acid and 1.1 moles vinyl acetate, dispersed in water.

SAMPLE 1 is an amphoteric surfactant tallow amphopolycarboxy-glycinate of formula:

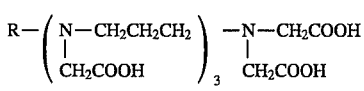

where R is alkyl derived from tallow fatty acid of typical composition 5% $C_{14}$, 30% $C_{16}$ and 65% $C_{18}$.

SAMPLE 2 is an amphoteric surfactant oleo amphopolycarboxy-glycinate of the same formula except that R is derived from oleic fatty acid.

SAMPLE 3 is a comparative example of cocoamidopropyl betaine, an amphoteric material, not within the invention, having the formula

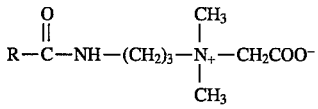

where R=derived from coconut fatty acid.

SAMPLE 4 is a commercial fat liquor.

All percentages are by weight of the wet blue or other leather that was being treated, unless otherwise stated.

EXAMPLES 1 to 4

100 g of bovine wet blue was accurately weighed (about 40 cm by 24 cm). This was placed in a drum with 200 g of water at 40° C. and 0.2 g of non-ionic emulsifier (Sunaptol MB, trademark, - I.C.I Ltd.). The leather was rinsed for 5 minutes to remove loose chrome salts. The liquor was drained and the leather rinsed with 200 g of water at 40° C. for 5 mins then the liquor drained again.

200 g water and 2 g Neutraktan DN (trade mark for a commercial buffer) were added and drummed at 35° C. for 90 minutes to neutralise the leather at pH 5.5. The drum was drained then the leather rinsed with 200 g of water at 35° C. for five minutes then drained again.

150 g of water was added along with 16.7 g of RESIN A (3% polymer) and treated at 40° C. for 30 minutes.

2 g of Coriacide Havana X3J (trade mark) dyestuff was added and the leather drummed for a further 60 mins at 40° C.

6 g of SAMPLE 1 (1.8% active product) was added and the leather drummed for a further 45 mins. at 40° C., after which time the temperature was decreased to room temperature and enough formic acid was added to adjust pH to 3.8. The leather was drummed for a further 30 minutes.

The drum was emptied, the leather rinsed with 200 g of water for 5 minutes then the leather was set out excess water removed) dried, conditioned and hand staked.

This procedure was repeated using each of samples 2, 3 and 4, each at 1.8% active product.

The treated leathers were assessed for softness by 'handle' relative to each other. The dyeing was assessed visually, being an assessment of levelness and uniformity of dye distribution within the substrate.

The treated leathers were tested for waterproofness by observing how long a drop of water placed on the surface took to penetrate the leather at 20–25° C.

The results are as follows:

| | Lubricating Fat Liquor | Softness | Dyeing | Water-proofness |
|---|---|---|---|---|
| Example 1 | Sample 1 | Good | Good | >60 min. |
| Example 2 | Sample 2 | Fair | Good | >60 min. |
| Example 3 | Sample 3 | Fair | Good | 5 min |
| Example 4 | Sample 4 | Good | Good | 2 min |

These results show the advantage in waterproof properties when using the surfactants in accordance with the invention in combination with a waterproofing resin.

EXAMPLES 5 TO 8

The process of Example 1 was repeated except that the steps of treating the leather with RESIN A and then the dyestuff were replaced by the single step of adding 150 g water together with 2 g Coriacide Havana X3J followed by drumming the leather at 45° C. for 60 minutes.

The same procedure was used in Examples 2, 3 and 4 at 1.8% active product.

The results were as follows:

| | Lubricating Fat Liquor | Softness | Dyeing | Water-proofness |
|---|---|---|---|---|
| Example 5 | Sample 1 | Good | Good | >60 min. |
| Example 6 | Sample 2 | Good | Good | 20 min. |
| Example 7 | Sample 3 | Good | Good | 4 min |
| Example 8 | Sample 4 | Good | Good | 1 min |

Example 5 shows that the invention, especially using SAMPLE 1, gives a water resistant leather in the absence of any waterproofing retanning resin.

EXAMPLE 9

The process of Example 1 was repeated except that the treatments with RESIN A, dyestuff and then SAMPLE 1 were replaced by adding 150 g water with 16 grams of a blend of equal parts (active product) SAMPLE 1 and RESIN A (3.6% total product) and the leather was treated at 40° C. for 60 minutes, 2 g of the dyestuff was then added and the leather drummed for a further 60 minutes at 40° C., and then the temperature was decreased to room temperature and the process continued as in Example 1.

The leather produced was flexible and supple, i.e., soft handle, the dyeing was level and uniform. The leather was also waterproof with no water penetration after 60 minutes.

EXAMPLE 10

The process of Example 9 was repeated except that the treatment was with 8 g SAMPLE 1 (2.4% active product) and 8 g RESIN A (1.4% active product) and a different dyestuff was used, namely 2 g Coriacide Orange Brown X3R.

A soft, full leather was produced, the dyeing was level and uniform. The leather was waterproof with no water penetration after 60 minutes.

EXAMPLE 11

100 g of chrome tanned bovine suede was accurately weighed. This was placed in a drum with 200 g of water and 2 g of Neutraktan DN and drummed at 35° C. for 90 minutes to neutralise the leather at pH 5.5. The drum was drained then the leather rinsed with 200 g of water at 35° C. for five minutes then drained again.

150 g of water was added along with 15 g of a blend of SAMPLE 1/RESIN A—75/25 weight active product/weight active product. (3.9% total weight active product on weight of wet blue) and the leather treated at 40° C. for 60 minutes.

2 g of Coriacide Orange Brown X3R dyestuff was added and the leather drummed for a further 60 minutes at 40° C., after which the temperature was decreased to room temperature and enough formic acid was added to adjust pH to 3.8. The leather was drummed for a further 30 minutes.

The drum was emptied, the leather rinsed with 200 g of water for 5 minutes, then the leather was set up, dried, conditioned and hand staked.

A soft leather was produced, dyeing was level and uniform. The leather was also waterproof with no water penetration after 60 minutes.

EXAMPLE 12

The same procedure as in Example 11 was followed, with chrome tanned sheepskin used as the substrate.

Again a soft leather was produced, dyeing was level and uniform. The leather was waterproof with no water penetration after 60 minutes.

EXAMPLE 13

100 g of chrome tanned bovine suede was accurately weighed. This was placed in a drum with 200 g of water and 0.2 g of non-ionic emulsifier (Sunaptol MB) at 40° C. The leather was rinsed for 5 minutes to remove loose chrome salts. The liquor was drained and the leather rinsed with 200 g of water at 40° C. for 5 minutes then the liquor drained again.

200 g of water and 2 g Neutraktan DN were added and drummed at 35° C. for 90 minutes to neutralise the leather at pH 5.5. The drum was drained then the leather rinsed with 200 g of water at 35° C. for five minutes then drained again.

150 g of water was added along with 7.5 g of a blend of SAMPLE 1/RESIN A—75/25 weight active product/weight active product (1.95% total weight active product on weight of wet blue) and the leather treated at 40° C. for 60 minutes.

2 g of Coriacide Orange Brown X3R dyestuff was added and the leather drummed for a further 60 minutes at 40° C.

A further 7.5 g of the 75/25 w/w blend of SAMPLE 1/RESIN A (1.95% total weight active product on weight of wet blue) was added and the leather drummed for 60 minutes.

The temperature was then decreased to room temperature and enough formic acid to adjust pH to 3.8 was added. The leather was drummed for a further 30 minutes.

The drum was emptied, the leather rinsed with 200 g of water for 5 minutes, then the leather was set up, dried, conditioned and hand staked.

A soft leather was produced, dyeing was level and uniform. The leather was waterproof with no water penetration after 60 minutes.

EXAMPLE 14

The same procedure as in Example 13 was followed, with chrome tanned sheepskin used as the substrate.

Again a soft leather was produced, dyeing was level and uniform. The leather was waterproof with no water penetration after 60 minutes.

We claim:

1. A process of rendering leather flexible and water repellant by applying to the leather an aqueous solution comprising an amphoteric surfactant, which has the formula $$R-Z-[\underset{\underset{Q}{|}}{N}A-]-_{n}NQ_2$$

wherein R is an alkyl, alkaryl or aralkyl group of at least eight carbon atoms, Z is a direct bond or an ether, ester or amide linkage, A is an alkylene or oxyalkylene group of 2 to 8 carbon atoms, each group Q is a carboxyl-containing group or hydrogen provided that at least two of the groups Q are carboxyl-containing groups, and n is 1 to 6, or a water-soluble salt thereof.

2. A process according to claim 1 in which R is $C_8$–$CH_{24}$ alkyl, each carboxyl-containing group Q has the formula —BCOOM where M is hydrogen or a cationic group that forms a water-soluble salt and B is an alkylene group of 1 to 6 carbon atoms.

3. A process according to claim 2 in which A is $(CH_2)_y$ where y is 2 to 6 and each group B is $(CH_2)_x$ where x is 1 to 4.

4. A process according to claim 3 in which n is 1 to 4, x is 1 or 2 and y is 2 or 3.

5. A process according to claim 4 in which Z is selected from a direct bond, an ether linkage, —$NHCOCH_2$—, —$OCOCH_2$—, —$CH_2COO$—, or —$CH_2CONH$—.

6. A process according to claim 1 in which a waterproofing resin is additionally applied to the leather.

7. A process according to claim 6 in which the waterproofing resin is applied before or with the surfactant.

8. Leather which is flexible and water repellent and which has been impregnated with an amphoteric surfactant which has the formula $$R-Z-[\underset{\underset{Q}{|}}{N}A-]_{n}NQ_2$$

wherein R is an alkyl, alkaryl or aralkyl group of at least eight carbon atoms, Z is a direct bond or an ether, ester or amide linkage, A is an alkylene or oxyalkylene group of 2 to 8 carbon atoms, each group Q is a carboxyl-containing group or hydrogen provided that at least two of the groups Q are carboxyl-containing groups, and n is 1 to 6, or a water-soluble salt thereof.

* * * * *